US010392083B2

(12) United States Patent
Van Aalst

(10) Patent No.: US 10,392,083 B2
(45) Date of Patent: Aug. 27, 2019

(54) VESSEL AND BOOM CONSTRUCTION

(71) Applicant: Safeway B.V., Dordrecht (NL)

(72) Inventor: Gerbrand August Wijnand Van Aalst, Dordrecht (NL)

(73) Assignee: SAFEWAY B.V., La Dordrecht (NL)

( * ) Notice: Subject to any disclaimer, the term of this patent is extended or adjusted under 35 U.S.C. 154(b) by 0 days.

(21) Appl. No.: 15/568,598

(22) PCT Filed: Apr. 25, 2016

(86) PCT No.: PCT/NL2016/050292
§ 371 (c)(1),
(2) Date: Oct. 23, 2017

(87) PCT Pub. No.: WO2016/171563
PCT Pub. Date: Oct. 27, 2016

(65) Prior Publication Data

US 2018/0141621 A1 May 24, 2018

(30) Foreign Application Priority Data

Apr. 23, 2015 (NL) ..... 2014696

(51) Int. Cl.
*E01D 15/22* (2006.01)
*B63B 27/14* (2006.01)
(Continued)

(52) U.S. Cl.
CPC ..... *B63B 27/143* (2013.01); *B63B 27/14* (2013.01); *B63B 27/30* (2013.01);
(Continued)

(58) Field of Classification Search
CPC ..... B63B 27/14; B63B 27/143; B63B 27/30; B63B 2017/0072; B63B 2017/141; E01D 15/00; E01D 15/22
(Continued)

(56) References Cited

U.S. PATENT DOCUMENTS 3,795,216 A * 3/1974 MacPherson ..... B63H 9/06 112/449
3,918,379 A 11/1975 McNary et al.
(Continued)

FOREIGN PATENT DOCUMENTS

CN 102815377 A 12/2012
DE 3543140 A1 6/1987
(Continued)

OTHER PUBLICATIONS

International Search Report PCT/NL2016/050292 dated Sep. 19, 2016.
(Continued)

*Primary Examiner* — Raymond W Addie
(74) *Attorney, Agent, or Firm* — Pillsbury Winthrop Shaw Pittman, LLP

(57) ABSTRACT

A vessel including a boom construction, especially a gangway construction, for transferring persons and/or cargo from said vessel to an offshore object or vice versa. The boom construction includes an elongated mast structure extending in a direction substantially upwards from a deck of said vessel. Said mast structure is pivotally mounted with respect to a hull of the vessel in a manner such as to be pivotable with respect to said hull about a single pivot axis only. The boom construction further includes a boom, especially a gangway, which is connected to the mast structure and which extends from the mast structure in a substantially sideward direction. Furthermore, the boom construction includes at least one actuator for pivoting the mast structure such as to compensate for at least a part of a roll movement of the hull of the vessel.

27 Claims, 5 Drawing Sheets

(51) Int. Cl.
*B63B 27/30* (2006.01)
*E01D 15/00* (2006.01)
*B63B 17/00* (2006.01)

(52) U.S. Cl.
CPC . *B63B 2017/0072* (2013.01); *B63B 2027/141* (2013.01); *E01D 15/00* (2013.01); *E01D 15/22* (2013.01)

(58) Field of Classification Search
USPC ..... 14/69.5, 71.3
See application file for complete search history.

(56) References Cited

U.S. PATENT DOCUMENTS

| | | | | |
|---|---|---|---|---|
| 4,369,538 | A | 1/1983 | Smedal | |
| 5,280,760 | A * | 1/1994 | Edwards | B63B 15/0083 114/141 |
| 5,509,368 | A * | 4/1996 | Wald | B63B 15/0083 114/39.21 |
| 5,934,214 | A * | 8/1999 | Ketterer | B63B 15/0083 114/143 |
| 8,109,291 | B2 * | 2/2012 | Fuegel | B66C 23/32 137/615 |
| 8,745,801 | B2 | 6/2014 | Prins | |
| 9,187,155 | B2 * | 11/2015 | Prins | B63B 27/14 |
| 2009/0320385 | A1 * | 12/2009 | Stoetzer | E02D 7/00 52/118 |
| 2013/0255012 | A1 | 10/2013 | Prins | |

FOREIGN PATENT DOCUMENTS

| | | | |
|---|---|---|---|
| EP | 1315651 | B1 | 8/2006 |
| EP | 1999009 | | 10/2007 |
| EP | 2505486 | A1 | 10/2012 |
| EP | 26669178 | A1 | 4/2013 |
| EP | 2855253 | B1 | 4/2016 |
| GB | 2480408 | A | 11/2011 |
| NL | 2005231 | | 2/2012 |
| NL | 2008920 | | 12/2013 |
| WO | 2007/113203 | A1 | 10/2007 |
| WO | 2009/118767 | A1 | 10/2009 |
| WO | 2012/047096 | A1 | 4/2012 |
| WO | 2013/164446 | A1 | 11/2013 |
| WO | 2013/180564 | A1 | 12/2013 |
| WO | 2016/089207 | A1 | 6/2016 |

OTHER PUBLICATIONS

Office Action dated Dec. 4, 2018 issued in corresponding Chinese Patent Application No. 201680035790.4.
Communication pursuant to Article 94(3) EPC dated Apr. 17, 2019 issued in corresponding European Patent Application No. 16731372.5.

* cited by examiner

VESSEL AND BOOM CONSTRUCTION

CROSS-REFERENCE TO RELATED APPLICATIONS

This is the U.S. National Stage of PCT/NL2016/050292, filed Apr. 25, 2016, which claims priority to Netherlands Application No. 2014696, filed Apr. 23, 2015, the contents of each of these applications being incorporated herein by reference in their entireties.

The invention relates to a vessel which is provided with a boom construction, especially a gangway construction, for transferring persons and/or cargo from said vessel to an offshore object, such as an offshore structure or a second vessel, or vice versa.

Often, transferring persons and/or cargo from a vessel to an offshore object takes place by using motion compensated gangway constructions provided on a vessel.

Different motion compensated boom constructions, especially motion compensated gangway constructions, and vessels provided with such motion compensated boom constructions are known.

For example, publication WO 2013/180 564 discloses a vessel provided with a crane-like gangway construction. Said crane-like gangway construction comprises a motion compensated mast structure, wherein a boom formed as a telescopically extendable gangway is extending substantially laterally away from said motion compensated mast structure. The mast structure is mounted to the deck of the vessel by means of a two-axes gimbal structure. Two hydraulic cylinder actuators, which are controlled by motion sensor input, are provided in order to keep the mast structure substantially upright with respect to the horizon despite of the vessel's pitching and rolling. Further, the mast structure is rotatably connected to the two-axes gimbal structure by means of a turntable such that the mast structure can rotate about its central axis. Each of the two hydraulic cylinder actuators is pivotally mounted with a first end to the deck by means of a spherical bearing, wherein another end of the respective hydraulic cylinder actuator is pivotally mounted to one of two transverse lever arms by means of a spherical bearing, wherein each of said two transverse lever arms extends laterally away from the turntable. Approximately halfway the mast structure, a first end of the gangway is attached to the mast structure such as to be pivotally about a horizontally extending hinge axis and the gangway is further supported by cables run over hoisting devices located near the top end of the mast structure in order to allow luffing of the gangway. A disadvantage of such construction may be that the gangway suspension may cause a relatively high bending moment action on the mast structure. In order to allow the mast structure to absorb such a moment and/or to create enough leverage to allow the construction to luff the gangway, the mast structure may be a relatively long and/or relatively heavy structure, e.g. with relatively high inertia. Hence, the maximum height at which the boom forming the gangway can be provided at a ship relatively may be restricted to a relatively large extent, e.g. due to the relatively heavy construction. Additionally or alternatively, such relatively heavy structure with relatively high inertia may require relatively high energy input to operate the structure. Another disadvantage of said motion compensated gangway construction may lie in that the roll and pitch motion compensation by means of hydraulic cylinder actuators, which are pivotally mounted by means of spherical bearings at both of its ends, can be relatively complex and/or relatively error prone. Besides, the levers on the sides of the mast structure of such crane-like gangway construction can take up relatively much deck space and/or may require that a deck is strengthened relatively much to be able to manage point loadings, e.g. in a case the levers are kept relatively short.

Furthermore, vessels provided with motion compensated gangway constructions are known, wherein the construction comprises a so-called Steward platform or a controllable hexapod platform with motion sensors and six hydraulic cylinders continuously driven based on data from said motion sensors in order to compensate motions of a vessel, e.g. in order to hold a platform substantially in an earth fixed steady position, wherein a first end of a gangway is mounted to the platform and a second end of the gangway is mounted to an offshore object, such as second vessel or an offshore structure, such as an oil or gas platform or an offshore wind turbine. However, such motion compensated gangway constructions are not only very complex and cannot only be relatively complex to control, which could lead to failure relatively easily and which for instance requires a specialist operator, especially a dedicated supplier furnished operator, to ensure safe working conditions, but do also require relatively high energy input to operate, especially because at least six cylinders require continuous high power consumption. It is noted that the workability of a hexapod type gangway construction can be relatively limited, e.g. due to the limit stroke of the cylinders and/or due to a structural limitation of the maximum angular compensation possible by said gangway construction. Further, motion compensated gangway constructions of the hexapod type need to stop operating, go back to a storage position, load or unload people to or from a platform of said construction, and then deploy a connection with an offshore object to or from which people are to be transferred, before further persons can be transferred. Consequently, no continuous people transfer is possible with such hexapod type gangway constructions. Besides, these hexapod type compensated gangway constructions can be relatively heavy structure. Moreover, the maximum height at which the gangway can be provided at a vessel can be restricted, at least when the footprint of the motion compensated gangway constructions is restricted. The maximum height difference between a deck of a vessel on which the construction is installed and a location to which the gangway can transfer persons can thus be relatively limited.

Besides, different known gangway constructions, both of the hexapod type and the crane-like type comprising a compensated mast structure, have overall construction weights which are often way too high for small vessels, and/or are relatively complicated to install on a vessel. Complicated installation may require relatively a lot of time, during which the vessel cannot be used.

It is an object of the invention to provide an alternative vessel and/or an alternative boom construction, especially an alternative gangway construction. In embodiments, the invention aims at providing a boom construction, wherein at least one disadvantage of prior art gangway constructions and/or other prior art boom constructions is counteracted, especially wherein at least one disadvantage mentioned above is counteracted. In particular, the invention aims at providing a boom construction, such as a gangway construction, especially a motion controlled boom construction, which is relatively light weight and/or which requires relatively low energy input to operate.

Thereto, the invention provides for a vessel provided with a boom construction, preferably a gangway construction, for transferring persons and/or cargo from said vessel to an offshore object or vice versa, wherein the boom construction comprises an elongated mast structure extending in a direction substantially upwards from a deck of said vessel, wherein said mast structure is pivotally mounted with respect to a hull of the vessel in a manner such as to be pivotable with respect to said hull about a single pivot axis only, wherein said pivot axis then may extend substantially in line with a longitudinal direction of the vessel, said boom construction further comprising a boom, preferably a gangway, connected to the mast structure and extending from the mast structure in a substantially sideward direction, said boom construction further comprising at least one actuator for pivoting the mast structure such as to compensate for at least a part of a roll movement of the hull of the vessel.

The invention is at least partly based on the insight that compensating the position of a mast structure only for a vessel's rolling and not for the vessel's pitching may result in a relatively simple construction, while the most critical movement of the vessel can still be compensated at least substantially. The tilting of the mast structure due to pitching of the vessel, which tilting is relatively limited with respect to potential tilting due to the vessel's rolling, may for instance be compensated at least partly by slewing the boom, especially the gangway, about the central axis of the mast structure, luffing the boom, and/or adapting the length of the gangway or other boom. Hence, the structure of the boom construction of the present invention can be greatly simplified with respect to for instance a gangway construction having a mast structure suspended by a two-axes gimbal structure, while the boom construction of the present invention does not or at most hardly compromise on the abilities of the boom construction to keep the boom, especially a gangway, relatively stable with respect to the fixed world. Moreover, only actively compensating the position of the mast structure for the vessel's rolling may facilitate that only a single actuator may be needed for compensating the mast's position, which may result in a relatively simple actuator controlling. Besides, the boom construction may, at least partly therefore, be relatively easy to operate, as a result of which no specialist operators need to be required, because the operation may be performed by crew members of the vessel, which may be additionally trained. Hence, the presence of dedicated supplier furnished operators may become superfluous, which can make the present boom construction relatively cost efficient, since often four dedicated supplier furnished operators are needed to allow a known hexapod gangway construction to be usable 24/7.

In preferred embodiments, the elongate mast structure may be a relatively long mast structure. For example, the elongate mast structure may have a length that is at least 4, at least 5, at least 8 or at least 10 times larger than the width and/or than the depth of said mast structure. Additionally or alternatively, the elongate mast structure can have a length that is at least 20%, at least 25%, at least 30%, or at least 35% of the length of the boom, especially being at least 20%, at least 25%, at least 30%, or at least 35% of the maximum length of the boom in case said boom is an extendable boom. It is noted that the boom may be formed and/or may comprise a gangway for transferring persons. A vessel, in particular a ship, provided with such boom construction having a boom being and/or comprising a gangway may for instance be utilized for crew transfer. Crew transfer by helicopters can for instance be replaced at least partly by deploying such ships, which for example can be relatively safely, cost efficient and/or swift.

Additionally or alternatively, the boom, especially a cargo boom or a so-called jib, may be provided with a trolley and/or a hoist, which trolley and/or hoist can be movable along at least a part of said boom. Alternatively or additionally, the boom, especially a cargo boom or a so-called jib, may be arranged to support a conduit and/or may support a conduit, e.g. a pipe, tube or hose. The conduit may be arranged to transfer cargo, preferably a pumpable cargo, such as a substantially fluid cargo, e.g. grout, water, oil, gas, especially liquefied natural gas (LNG), etcetera. The boom construction can for instance be used to load LNG onto a tanker or other vessel. Alternatively, the boom construction may for example be used for grouting at an offshore location, such as at a location for an offshore wind farm. Advantageously, at least a part of the conduit may be substantially flexible. Preferably, the conduit can be substantially formed as a flexible conduit, especially a hose.

For instance in case the boom is an extendable boom, preferably a telescopically extendable boom, a substantially flexible and/or pivotable conduit or conduit portion may sag down in at least a retracted state of the boom. In a more extended state of the boom, the flexible and/or pivotable conduit or conduit portion may be more tightened. Alternatively or additionally, at least a part of the conduit can be arranged to be extendable and/or retractable, e.g. in a telescopic manner.

In embodiments, the boom, especially a gangway, can be connected rotatably to the elongated mast structure in order to allow the boom to slew about said elongated mast structure. For example, the boom can be connected to the mast structure by connecting it to a slewing platform that is rotatably connected to mast structure. Advantageously, said slewing platform can be rotatably connected to an elevation unit that is adjustable in height along said elongated mast structure. The slewing platform can be motorized in order to control the slewing of the slewing platform and/or the boom about the longitudinal axis of the mast structure, preferably by means of one or multiple radial piston motors. The radial piston motor, which can be strong at low speed and high torque, may be advantageous for controlling the rotation of the slewing platform and can further be brought into a neutral position, e.g. out of gear, relatively quickly, which may advantageous when the slewing platform is to be brought into a passive mode or so-called float mode.

By providing at least one counterweight for compensating at least partly for a moment exerted on the mast structure by the boom, wherein the at least one counterweight has a center of mass located at a lateral side of the mast structure substantially opposite to a side of the mast structure at which said boom extends from said mast structure, the boom construction can be relatively balanced.

In comparison to a crane-like boom construction having a gangway forming boom suspended by cables engaging a mast structure of said crane-like boom construction at a relatively high point, the counterweight which can be provided in embodiments of the inventive boom construction of the present invention can advantageously reduce a moment on the mast structure of the boom construction, as a result of which the mast structure, and therefore the complete boom compensation construction, can be of relative light weight design, which for instance may facilitate that a relatively high mast structure can be provided at a vessel of certain dimensions. Hence, the height at which the boom engages the mast structure can be positioned relatively high, resulting in that the boom construction of the present invention can have a relatively high maximum transfer height, i.e. that it can be used to transfer persons and/or cargo to and/or from a place located relatively high at an offshore object, such as an offshore structure, e.g. a production platform or offshore wind turbine, or vessel.

Additionally or alternatively, the counterweight may reduce a moment on slew bearings for enabling the boom to slew about the mast structure or for enabling the mast structure or a top portion of the mast structure to rotate about its longitudinal axis. As a result, such slew bearings and/or one or more actuators for driving the slewing of the boom and/or mast structure or a mast structure top portion may be exposed to relatively little friction and/or can be relatively light, small, simple and/or cost efficient and/or may be long lasting due to the relatively small load applied thereto.

Balancing the mast structure at least partly by means of a counterweight may also facilitate that one or more potential luffing cylinders or other luffing actuators can be of relatively light design and/or that relatively low energy may be required for actively compensating an angle of inclination of the boom, e.g. in order to actively compensate at least partly for a heave motion of the vessel. Furthermore, in case during use a distal end of the boom is coupled to an offshore object and the boom is in a passive or float mode, the balancing by means of the counterweight may facilitate that relatively little force is exerted on the offshore object and/or the boom. This may be advantage in view of safety and/or cost efficiency, e.g. because nitrogen bottles, cylinders, and/or power may be unnecessary during said passive or float mode and/or because then no operating system is needed for operating luffing, telescoping and/or slewing actuators for controlling the boom, which may also result in that it can be relatively simple to operate the boom construction, thereby counteracting the need for dedicated supplier furnished operators.

Additionally or alternatively, the at least one actuator for pivoting the mast structure such as to compensate for at least a part of a roll movement of the hull of the vessel can be of relatively light design and/or may need relatively low energy only, because by balancing the mast structure it may be arranged that the mast structure exerts only a relatively small moment on said at least one actuator for pivoting the mast structure.

Moreover, a further advantage of balancing the boom by means of one or more counterweights may be that it can facilitate that the boom construction, e.g. the mast structure with the boom and the counterweight mounted thereto, can be installed relatively easily, for example in a single lift operation, because the center of gravity of the boom construction may lie inside the mast structure, e.g. on a center line of said mast structure. For instance, the boom construction can be provided with hook, bracket, clutch or other means for allowing a crane or other hoisting device to engage the boom construction. Said means may preferably be provided at a top of the mast structure, especially substantially on said center line of the mast structure.

Preferably, the boom may be a telescopically extendable boom, e.g. for absorbing length differences between the position at the mast structure where the boom engages said mast structure and the position at which the distal end of the boom is to be located, e.g. at a certain position at an offshore object. More preferably, a telescopically extendable boom with at least three telescopic parts is used, including a main part that engages the mast structure and at least two laterally moveable parts that are arranged to provide for lateral movement relative to the main part and relative to each other. This makes it possible to reduce the relative speed of motion between the different parts of the telescopically extendable boom.

Preferably, the boom construction can be provided with at least one telescoping actuator, e.g. a telescoping cylinder, or cable transmission, for extending and/or retracting the telescopically extendable boom, e.g. in order to position a distal end portion of the boom at a desired position, such as for instance at certain position at an offshore object, at which position the end portion of the boom may be coupled to said object. Alternatively, a cable transmission actuator may be used, including for example using a cable, a winch, wheels and/or blocks part of which may be located on the main part and part on a moveable part of the boom.

When two or more moveable telescoping parts are used, at least one telescoping actuator may be provided for each moveable telescoping parts. Alternatively a single actuator, or at least fewer actuators may be used, in combination mechanical coupling between the moveable parts that transmits relative motion between a pair of the parts at a predetermined ratio to a next pair of the parts.

For instance thereto, the boom construction may comprise a coupler, preferably located at or near a distal end of the boom, for coupling the boom to an offshore object, e.g. an offshore structure or another vessel. Preferably, the coupler, which can be a magnet coupler, can be arranged for a pivotable coupling, especially a pivotable coupling having three degrees of freedom, e.g. by comprising a spherical bearing or a ball and socket joint.

Advantageously, the telescopically extendable boom, which can be formed as a telescopically extendable gangway, can comprise at least two parts that can telescopically move with respect to each other. In embodiments, the telescopically extendable boom may comprise a main part and a second part, said second part being telescopically movable with respect to the main part in order to telescopically extend the length of the boom, and optionally a third part telescopically movable with respect to the second part in order to telescopically extend the length of the boom, wherein the boom further comprises a movable counterweight for at least partly compensating for a moment exerted on the mast structure by the movable second and optional third boom part, e.g. formed as a movable second and optional third gangway part, wherein the movable counterweight has a center of mass located at a lateral side of the mast structure substantially opposite to a side of the mast structure at which said movable boom part is located.

Preferably, the boom construction can be arranged such that a certain displacement of the center of mass of a movable boom part during extending or shortening of the boom can be substantially compensated by a corresponding displacement of the at least one movable counterweight in a substantially continuous manner, for example by means of a mechanical connection, for instance a mechanical connection comprising one or more sheaves and one or more cables or steel wires interconnecting a movable part of the boom with the counterweight in a manner that a change of the moment said movable boom part exerts on the mast structure results in a corresponding change corresponding change of the moment said movable counterweight exerts on the mast structure. Alternatively, the boom can be extended or retracted by means of other actuators, e.g. a hydraulic system, which can comprises on or multiple hydraulic cylinders and/or hydraulic motors, or a cable transmission.

Advantageously, the boom construction can comprise at least one telescoping actuator, e.g. a hydraulic cylinder, or cable transmission, for moving the movable boom part and for simultaneously moving the movable counterweight, which can be mechanically interconnected to said movable boom part, in an at least partly opposite direction. In embodiments wherein the telescoping boom contains two or more moveable telescoping parts, one or more telescoping actuators may be provided for each of the moveable telescoping parts. Alternatively, a mechanical transmission system may be provided between the parts that is arranged to maintain a predetermined ratio between the movements of parts. Although the movable boom part or parts and the movable counterweight can in embodiments be mechanically interconnected in such a manner that such when one of them moves in one direction the other will be moved in a corresponding, at least partly opposite, direction, such that both can be kept balanced when the boom is lengthened or shortened, other designs are possible as well. For example, the movable boom part or parts and the movable counterweight can both be driven by a separate actuator, wherein a controller can then be arranged to control said actuators such as to keep said movable boom part and said movable counterweight balanced with respect to each other.

In embodiments, the actuator or actuators for driving the at least one movable counterweight and/or the at least one movable boom part can be a radial piston motor. The radial piston motor may for instance drive a pinion engaging a rack, wherein the pinion or the rack can be provided at a first boom part and the other one of the rack and pinion can be provided at a cooperating boom part. The radial piston motor, which can be strong at low speed and high torque, may render a gearbox superfluous, thereby allowing a relatively swift retraction and/or extension of the boom. By using one or more radial piston motors, the actuator can further be brought into a neutral position, e.g. out of gear, relatively quickly. Hence, the extendable boom, especially extendable gangway, can be brought into a passive mode relatively swiftly, which can for instance be advantageously when a distal end portion of the boom is coupled, preferably in a pivotable manner, to an offshore object. The boom can thus be actively extended to the desired length, and the length of said boom can then actively be shortened and lengthened to compensate for movements of the vessel, and for instance also for movements of the offshore object, in order to keep the distal end portion of the boom and/or coupling means provided thereon relatively motionless with respect to a desired position on the offshore object the boom is to link up with.

After the boom has been coupled to the offshore object, the boom can be brought into a passive mode, wherein the boom is extending and retracting due to changes in the distance between the point at which the boom is mounted to the mast structure and the point at which the boom is temporarily coupled to the offshore object. Preferably, the one or more counterweights that can be mechanically connected to one or more respective ones of one or more movable boom parts can then continuously be passively adjusted in correspondence with the movements of the boom. Such passive adjusting of the boom, and preferably of the one or more movable counterweight as well, can be relatively energy efficient, cost efficient, and/or error insensitive.

In preferred embodiments, in which the boom construction has at least one actuator for pivoting the mast structure such as to compensate for at least a part of a roll movement of the hull of the vessel, the boom construction is arranged to overcompensate the mast structure for roll movement of the vessel. During rolling of the vessel, said mast structure would have tilted laterally with respect to the fixed world, e.g. laterally away from an offshore object, in case the motion of said mast structure would not have been compensated.

It is noted that overcompensation can for instance be understood as tilting the mast structure with respect to the hull slightly further than is needed to keep said mast structure in its neutral upright position.

Advantageously, especially in case the single pivot axis, about which the mast structure can pivot with respect to the vessel's hull, is located relatively high with respect to the longitudinal center line about which the vessel rolls during use, the boom construction can be arranged to overcompensate the mast structure in such a manner that, during rolling of the vessel, the center line of the mast structure can be tilted with respect to said imaginary or virtual vertical plane opposite to the direction in which the vessel rolls.

For example, in case the hull of the vessel, seen from the rear side of the vessel, rolls to the right, i.e. clockwise, the mast structure can be compensated by tilting it to the left, i.e. anticlockwise, and can be overcompensated by tilting it even further to the left. In this case, the hull of the vessel, seen from the rear side of the vessel, rolls to the right, i.e. in the clockwise direction, such that the starboard side of the hulls is located lower than in the neutral position of the hull, the single pivot axis about which the mast structure can pivot will be moved to the right. In case the longitudinal center line of mast structure would only be compensated such as to keep it completely parallel with the initial direction in which the longitudinal center line of mast structure extended in the neutral position of the vessel, the point of the mast structure at which the boom is connected to the mast structure would be moved to the right during said rolling of the hull of the vessel. As a result, said point at which the boom is connected to the mast structure would, be moved, seen in the horizontal direction, towards to, or away from, an offshore object located aside the vessel. Although such lateral displacement of said point may for instance be compensated for at least partly by retracting or extending the length of the boom, it can alternatively or additionally be done by overcompensating the mast structure, i.e. tilting said mast structure slightly further to the left than is needed to keep said mast structure in its neutral upright position. Hence, said point at which the boom is connected to the mast structure can be kept back to the left.

In the example described above, the hull rolls clockwise and the mast structure is tilted anticlockwise to compensate, and is tilted even further anticlockwise to overcompensate. However, in case the hull tilts over at its port or larboard side, and rolls anticlockwise, the mast structure can be tilted clockwise in order to compensate it, and can be tilted even further clockwise in order to overcompensate it. Normally, during use, the vessel will roll back and forth between port and starboard, and can be overcompensated by alternatingly pivoting it clockwise and anticlockwise.

As a result, the boom construction can at least partly compensate for a lateral displacement of said single pivot axis, because the overcompensation of the mast structure can facilitate that the point at the mast structure where the boom is connected to said mast structure is laterally displaced with respect to the laterally displaced pivot axis in a direction opposite to the direction in which said pivot axis is displaced laterally. Consequently, the overcompensating of the mast structure can counteract that a distance, e.g. a substantially horizontal distance, between a point where the boom is connected to said mast structure and a point at an offshore object to be temporarily connected to the vessel by means of the boom, will lengthen and/or shorten relatively much. For example, the extent to which the boom can be extended and/or retracted may be relatively limited, which can result in a relatively safe use compared to known constructions of which the gangway, bridge or other boom extends or retracts to a relatively high degree. In preferred embodiments, the gangway construction is arranged to compensate for the rolling of the vessel's hull substantially merely by rotating the mast structure about said single pivot axis and by luffing the boom if needed, thus substantially without retracting and/or extending the length of the boom. Additionally or alternatively, it can be an advantage of the boom construction that it can be used when the vessel rolls relatively much, e.g. due to relatively severe conditions and/or due to relatively poor movement behavior of the vessel, which can result in a relatively high workability and/or relatively safe use of the boom construction.

It is noted that the overcompensating of the mast structure, and/or undercompensating there off, e.g. in case the single pivot axis, about which the mast structure can pivot with respect to the vessel's hull, is in its neutral position located below the longitudinal center line about which the vessel rolls during use, can thus reduce or even eliminate the need of telescoping a boom. Especially in case the boom construction is used for transferring persons, e.g. in case the boom is or comprises a gangway, it can be highly advantageous that the boom is not—or only to a little extent—telescoping during use, e.g. during the actual transfer of the person(s), because mutually moving boom parts, e.g. an inner boom part moving within an outer boom part, can evoke a feeling of unease to people. The boom construction may thus be relatively safe to use and/or relatively pleasant to use.

Due to the overcompensating of the mast structure and/or due to the undercompensating of the mast structure, the latter which for instance may be understood as tilting the mast structure with respect to the hull of the vessel slightly less then would be needed to keep the mast structure completely vertically upright, the boom construction can be relatively simple, relatively cost efficient, and/or relatively long lasting. This, for instance, because the boom construction may in such cases lack the capability of extending and retracting the boom length, and may for instance only be arranged to pivot the mast structure about its single pivot axis and to luff, i.e. raising and lowering, the boom with respect to the longitudinal direction of the mast structure. As another example, the boom construction may be arranged only to pivot the mast structure about its single pivot axis, luff the boom with respect to the mast structure, and slew the boom with respect to the mast structure. Nevertheless, the boom may in advantageous embodiments be arranged to become extended and retracted, e.g. in order to compensate for small deviations not compensated for by the overcompensating and/or luffing, and/or slewing.

It is noted that the invention not only relates to a vessel provided with a boom construction, especially a gangway construction, as disclosed herein, but that the invention also relates to such a boom construction, especially gangway construction, as such.

Advantageous embodiments according to the invention are described in the appended claims.

By way of non-limiting examples only, embodiments of the invention will be described with reference to the accompanying figures in which.

It is noted that the figures show merely preferred exemplary embodiments according to the invention. In the figures, the same reference numbers refer to equal or corresponding parts.

Figure 1:
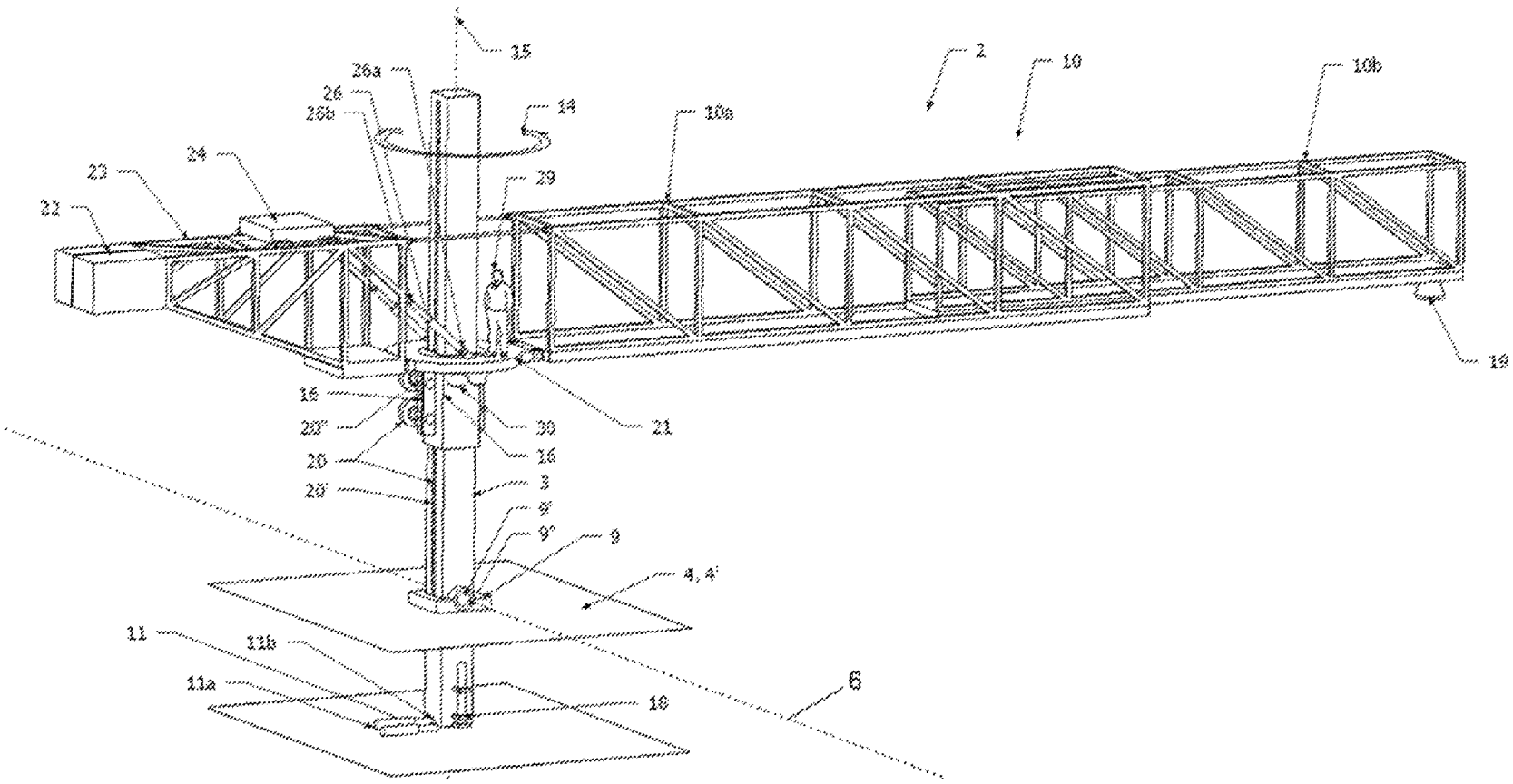
FIG. 1 shows a schematic perspective view of an exemplary embodiment of boom construction according to the invention.
Figure 2:
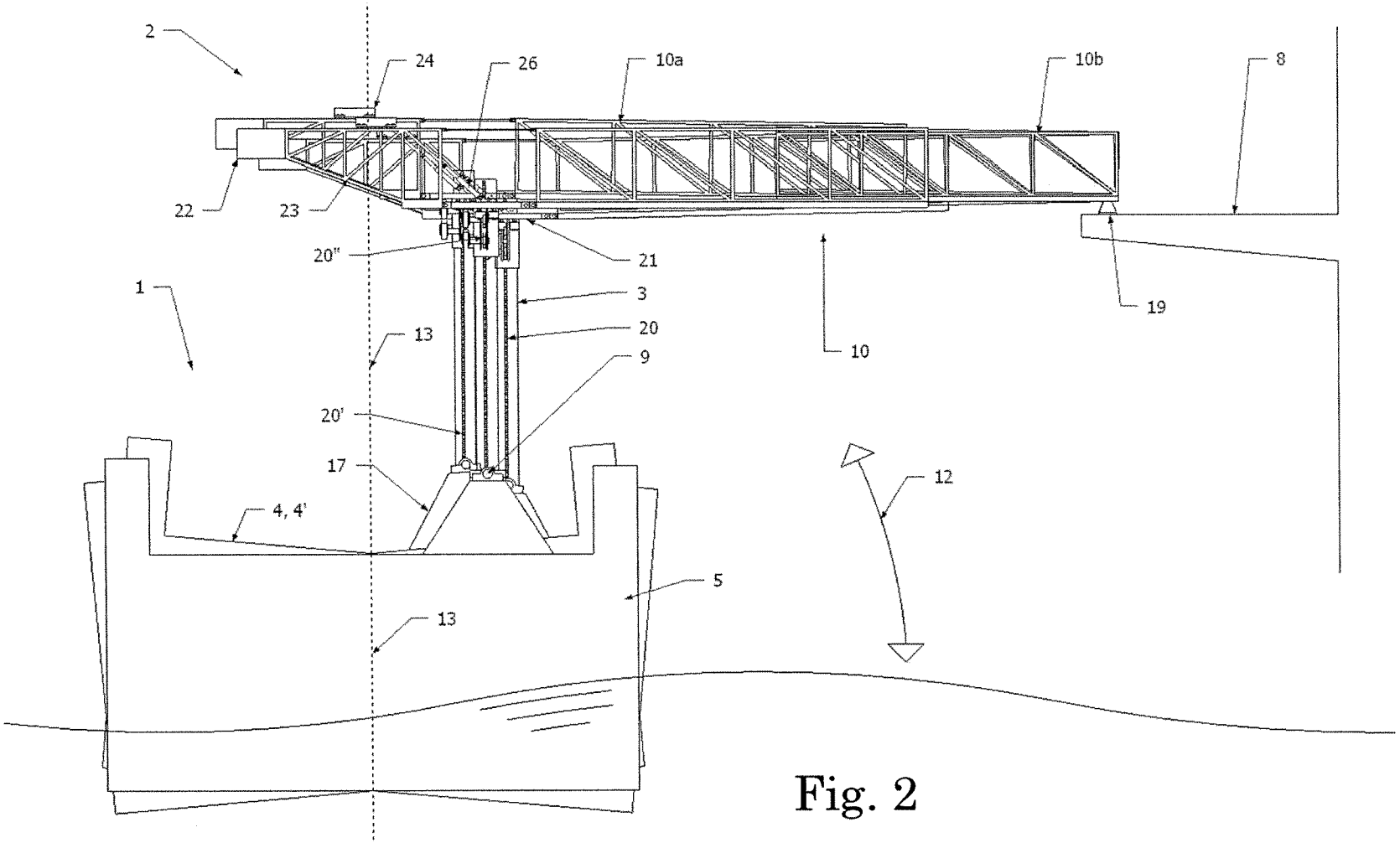
FIG. 2 shows schematic, partly cut-away views of an alternative boom construction provided on a vessel, wherein the vessel and the boom construction are shown in three different positions.
Figure 3:
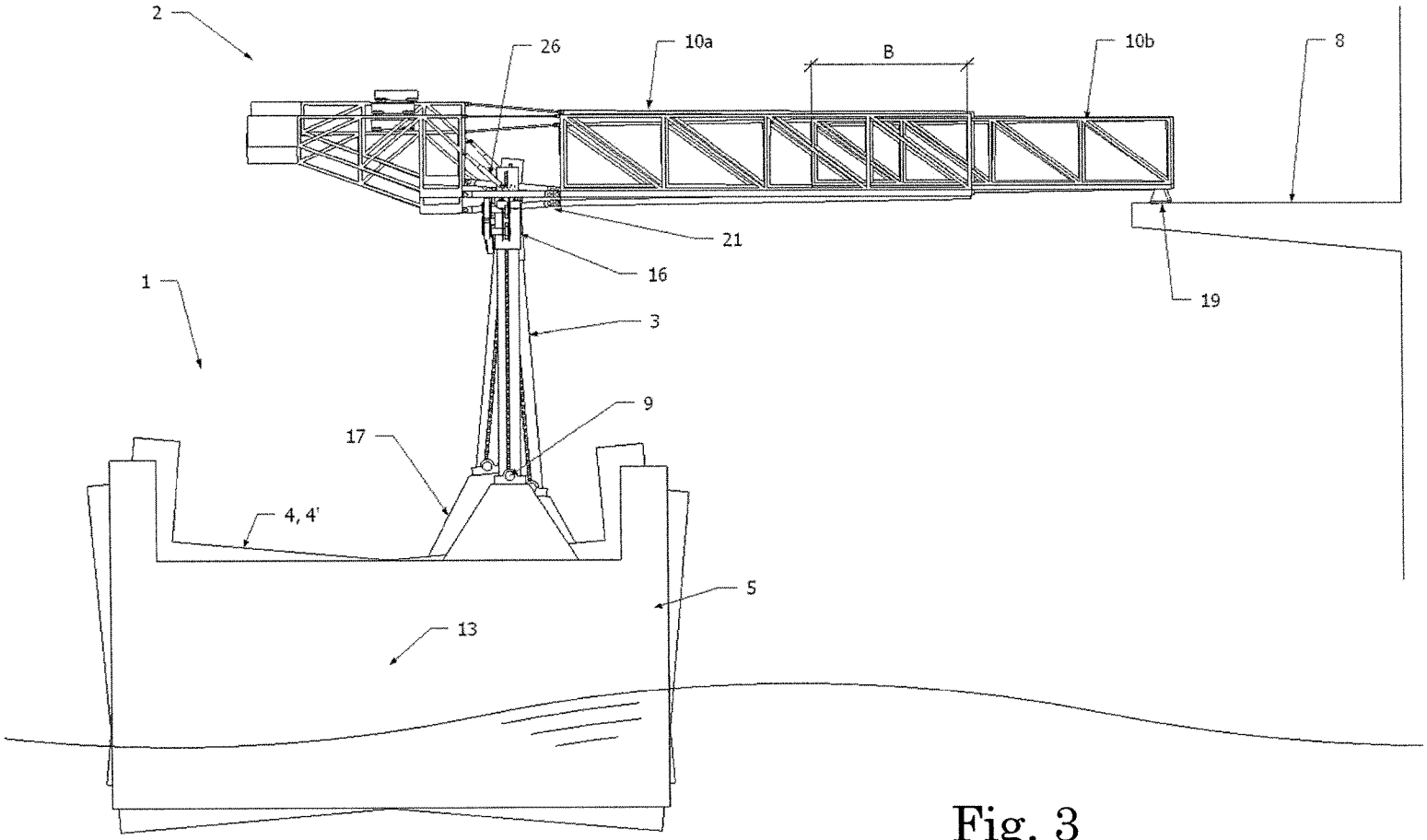
FIG. 3 shows schematic, partly cut-away views of the boom construction and the vessel of FIG. 2 in three different positions.

FIG. 1 shows a boom construction 2 for a vessel according to an aspect of the present invention and FIGS. 2 and 3 show a vessel 1 provided with an alternative embodiment of the boom construction 2 in different positions. The boom construction 2 is for transferring persons 29 and/or cargo 7 from said vessel 1, especially when in seaway, to an offshore object 8, such as an offshore structure or another vessel, or vice versa. Advantageously, the boom construction 2 is formed as a gangway construction 2 for transferring persons 29. Here, the boom construction 2 comprises an elongated mast structure 3 extending in a direction substantially upwards from a deck 4 of said vessel 1, e.g. the weather deck 4' of said vessel 1. The mast structure 3 can for instance be or comprise a mast or column, e.g. extending substantially transverse to a deck of the vessel 1 during use. Said mast structure 3 is pivotally mounted with respect to a hull 5 of the vessel 1 in a manner such as to be pivotable with respect to said hull 5 about a single pivot axis 6 only. The mast structure 3 can be pivotally mounted with respect to the hull 5 of the vessel 1 by means of a pivot connection 9. For example, said mast structure 3 can comprise a hinge part 9' for pivotally mounting the mast structure 3 to the hull 5 of the vessel 1 and/or the vessel may be provided with a cooperating hinge part 9".

The mast structure 3 can be mounted to the vessel 1 in such manner that said mast structure 3 cannot pivot with respect to the vessel 1 about another axis, and can then thus substantially not be compensated for the vessel's pitching movements.

It is noted that the mast structure 3 can extend substantially upright during use and/or in a substantially vertical direction, e.g. in a direction deviating for instance at most 15°, at most 10° or at most 5° from a completely vertically upright direction with respect to the horizon.

Moreover, it is noted that the vessel 1 can advantageously be a ship and/or an elongated vessel, e.g. a mono hull vessel or ship. With respect to said single pivot axis 6 is noted that said pivot axis 6 can preferably extend substantially in line with the longitudinal direction of the vessel 1.

Further, the boom construction 2, here formed as a gangway construction 2, comprises a boom 10, which preferably can be formed as a gangway 10 or so-called bridge, especially an articulating boom, bridge or ramp, connected to the mast structure 3 and extending from the mast structure 3 in a substantially sideward direction. Additionally or alternatively, such as for instance is the case in the exemplary embodiments of FIGS. 6 and 7, the boom 10, especially when being a cargo boom or a so-called jib, may be provided with a trolley 27 and/or a hoist 28. Said trolley 27 and/or said hoist 28 can be movable along at least a part of said boom 10, and/or said hoist 28 may be arranged for hoisting cargo 7. Alternatively or additionally, the boom 10, especially a cargo boom or a so-called jib, may be arranged to support a conduit and/or may support a conduit, especially an at least partly flexible conduit, which may be used for pumping over gas, liquid, and/or one or more other fluids, including substantially liquid mixtures, such for instance grout.

Furthermore, the boom construction 2 comprises at least one actuator 11 for pivoting the mast structure 3 such as to compensate for at least a part of a roll movement 12 of the hull 5 of the vessel 1, especially by pivoting said mast structure 3 about said single pivot axis 6.

Advantageously, said at least one actuator 11 can be a piston actuator or a cylinder actuator, especially a hydraulic cylinder actuator 11. A first end 11*a* of the cylinder 11 can be attached to the hull 5 of the vessel, e.g. to a middle deck 4" or lower deck, whereas a second end 11*b* of the cylinder can be attached to the mast structure 3, preferably by means of a pivot connection, more preferably a pivot connection having a pivot axis being substantially parallel to the single pivot axis 6 for pivoting the mast structure 3 with respect to the vessel's hull 5. Since the mast structure 3 can only pivot with respect to vessel's hull 5 about a single axis 6, the pivot connection between the cylinder actuator 11 and the mast structure 3 can be relatively simple in comparison to a connection between a cylinder and a conventional mast structure rotatably about two transverse horizontal pivot axes, which latter for instance may require a spherical bearing.

Although the boom construction 2 of the present invention comprises at least one actuator 11 for pivoting the mast structure 3 such as to compensate for at least a part of a roll movement 12 of the hull 5 of the vessel 1, said construction 2 may comprise multiple, e.g. two, actuators, preferably multiple actuators each being capable of compensating the mast structure 3 at its own, such that at least one spare mast structure pivoting actuator can be present when one of the actuators fails unexpectedly. Contrary to currently known hexapod type gangway constructions, which have limited redundancy, embodiments of the present boom construction can thus be relatively failproof. For example, two cylinder actuators can be provided substantially parallel, e.g. connected to the same lateral side of the mast structure 3, thereby saving space at the opposite lateral side of the mast structure 3.

As can be seen in FIG. 1, the mast structure 3 can extend from above the single pivot axis 6 beyond said single pivot axis 6 to a point located below said single pivot axis 6, wherein said at least one actuator 11 for pivoting the mast structure 3 engages the mast structure 3 at a position located below said single pivot axis 6, wherein said at least one actuator 11 can preferably comprises a piston actuator, especially a hydraulic piston actuator or a so-called hydraulic cylinder. By allowing a part of the mast structure 3, e.g. at least 10%, at least 15% or at least 20% or even more of the length of the mast structure 3, to extend or protrude below said single pivot axis 6, the at least one actuator 11 can engage the mast structure at a position relatively far from said pivot axis 6, without being in the way at a position above said pivot axis 6, e.g. without hindering a mechanism 16 for elevating the boom 10 and/or hindering an elevator or stairs for providing access to the boom 10 that preferably can form a gangway 10.

Figure 4:
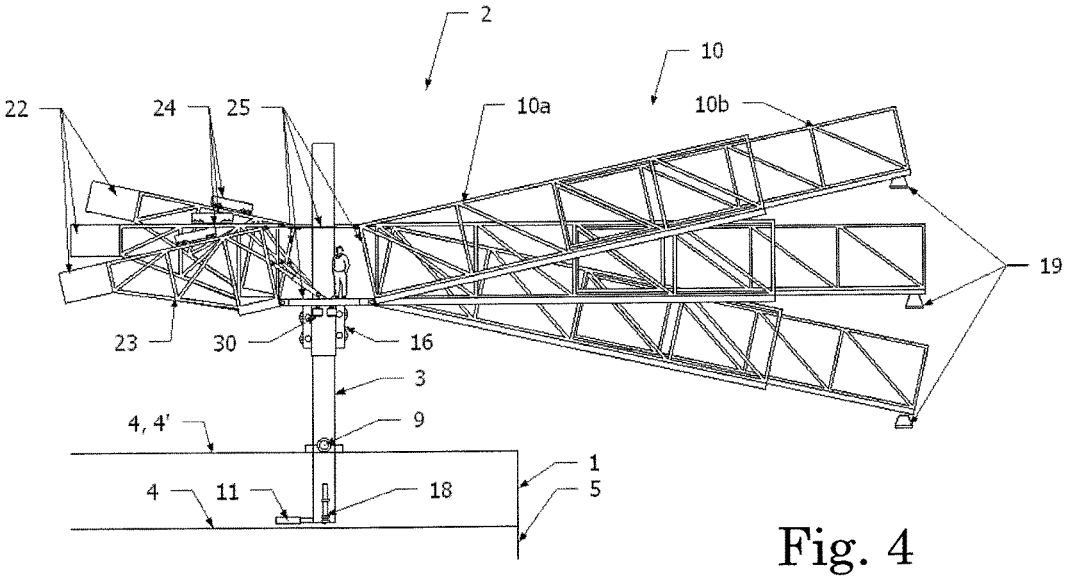
FIG. 4 shows a schematic, partly cut-away view of the boom construction of FIG. 1 in three different positions.
Figure 5:
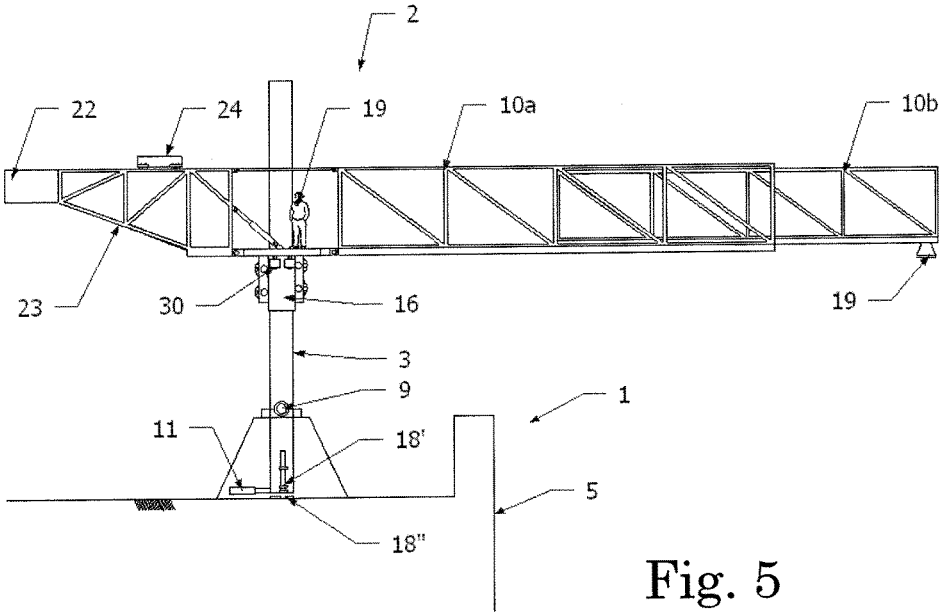
FIG. 5 shows a schematic, partly cut-away view of the boom construction of FIGS. 2 and 3.

As for instance can be seen in FIGS. 4 and 5, which show two alternative embodiments, the boom construction 2 can be mounted to a vessel 1 in different manners. For example, the hinge constructing 9 by which the mast structure 3 may be supported may be mounted on a deck 4, e.g. a platform working deck 4' or working deck, as is the case in the embodiments of FIG. 4. Alternatively, the hinge constructing 9 may be attached to or part of a pedestal 17, which can comprise a housing for housing the at least one actuator 11 for compensating the mast structure 3. Preferably, the hinge construction 9 is located at a top side of the pedestal 17.

It is noted that the vessel 1 and/or the boom construction 2 may be provided with a locking mechanism 18 for locking the mast structure 3, e.g. in a substantially upright position. When the boom construction 2 is not in use, e.g. when the vessel 1 is sailing or when the vessel is moored, the boom construction can be in a parked state, in which the mast structure 3 can be locked, and preferably in which state the boom 10 can be moved down such as to rest with a distal end portion on the deck 4 of the vessel 1. For example, said locking mechanism 18 may comprises a locking pin 18' and a locking hole 18" into which the locking pin 18' can be inserted and/or mechanically locked in order to prevent the mast structure from pivoting about its pivot axis 6. Due to such design, the mast structure 3 can be locked in a relative simple and reliable manner. Although the locking pin 18' may in the shown embodiments be slidably attached to the mast structure 3 and the hole 18" may then be provided at a fixed position with respect to the hull 5, the locking hole may in alternative embodiments be provided at the mast structure 3 while the locking pin 18' may then be slidably mounted to the vessel's hull 5. In embodiments, the locking mechanism can be provided in the pedestal 17.

Advantageously, the boom construction 2 can be provided with a so-called smit bracket construction for fixedly attaching one or more respective boom construction parts, e.g. its pivot construction 9 and/or its pedestal 17 to the vessel 1. One or more first parts of said smit bracket construction, e.g. one or more smit brackets, can be provided, which can become mounted to the vessel, e.g. to or on a deck 4 of the vessel 1, when the vessel in use, e.g. during sailing. One or more corresponding second parts of the smit bracket construction can be provided at the mast structure 3 and/or at a pedestal 17 of a boom construction 2. For example, the one or more first parts can be welded to the deck while the vessel is not at a dock, but for instance in seaway, and the vessel may subsequently be in a dock or harbor for a relatively short period while the boom construction is fixedly mounted to the pre-installed first parts. Due to the smit bracket construction, the boom construction 2 can be mounted to the vessel 1 in a relatively simple and/or fast manner.

Besides, it is noted that the vessel 1 and/or the boom construction 2 can be arranged to control the at least one actuator 11 in order to allow said at least one actuator 11 to compensate for at least a part of the roll movement 12 of the hull 5, especially in such manner that the center line of the mast structure 3 can during rolling of the vessel 1 be kept substantially parallel with a virtual or imaginary vertical plane 13 extending in the longitudinal direction of the vessel 1. As can be seen best in FIG. 2, the mast structure 3 can thus be kept substantially straight up with respect to fixed world, even when the vessel 1 is rolling. Since the mast structure 3 can only pivot with respect to the vessel 1 about said single pivot axis 6, the mast structure 3 may thus move along with the pitching movements of the vessel. However, angular rotations of a vessel due to pitching are usually much smaller than angular rotations due to a vessel's rolling. In case of a mast structure fixedly connected to a vessel's hull and/or deck, a mast structure will usually sway far less due to the vessel's pitching than due to the vessel's rolling. By only compensating the mast structure for a vessel's rolling and not for the vessel's pitching, up to 80% or 90% or even more of the swaying of the mast structure 3 can be reduced, whereas the construction can be considerably simplified with respect to a mast structure that can be compensated about two substantially transverse horizontal pivot axes. The present invention may thus result in a relatively simple construction, while the most critical movement of the vessel 1 can still be compensated for substantially. The tilting of the mast structure 3 due to pitching of the vessel 1, which tilting usually is very limited with respect to potential tilting due to the vessel's rolling, may for instance be compensated by slewing the boom 10 about the central axis 15 of the mast structure 3.

The at least one actuator 11 for compensating the mast structure 3 for the vessel's rolling can be controlled by means of a controller or control unit which get input from one or more motion sensors, e.g. included in a motion reference unit, e.g. a vertical motion reference unit, which may be provided at or in the mast structure 3. The controller may be arranged to drive the at least one actuator 11 to compensate the mast structure 3, e.g. the controller can control the at least one actuator 11 at least partly based on input provided by one or more position sensors, e.g. provided at the vessel 1 and/or at the mast structure 3.

As is shown in FIG. 3, in embodiments, the vessel 1 may be arranged to overcompensate the mast structure 3, which mast structure 3 due to the rolling of the vessel would have tilted laterally in case the motion of said mast structure would not have be compensated. Especially, a controller may be arranged such as to drive the at least one actuator 11 to overcompensate the mast structure 3 in such manner that, during rolling of the vessel 1, the center line 15 of the mast structure 3 can be tilted with respect to a virtual vertical plane 13 extending in the longitudinal direction of the vessel 1 in a direction opposite to the direction 12 in with the vessel 1 rolls. As a result, a position at which the boom 10 is connected to the mast structure 3 can be kept relatively stationary with respect to a situation in which the mast structure would be compensated, but not overcompensated, as can be seen when comparing FIGS. 2 and 3. Hence, changes in the distance between said connection point at a point at an offshore object temporarily connected by means of the boom 10 can be counteracted or can at least be kept relatively small.

It is noted that the boom 10 can preferably be an telescopically extendable boom 10, e.g. comprising a first part 10*a* not laterally movable with respect to the mast structure 3, which can for instance be rotatably connected to said mast structure 3, and a second part 10*b* laterally movable with respect to said first part 10*a* and thus laterally movable with respect to the mast structure 3. For example, the second part 10*b* can be formed as an inner boom, especially an inner bridge, movable within an outer boom 10*a*, especially an outer bridge 10*a*, formed by the first boom part 10*a*.

In further embodiments, the boom 10 is a telescopically extendable boom 10 with three or more telescoping parts. In an embodiment such a telescopically extendable boom 10 comprises a first telescoping part 10*a* that is not laterally movable with respect to the mast structure 3, a second telescoping part 10*b* laterally movable with respect to said first telescoping part 10*a* and a third telescoping part 10*c* laterally movable with respect to said second telescoping part 10*c*. For example, the second and third telescoping part 10*b,c* can be formed as inner bridges movable within the first and second gangway parts 10*a, b* respectively. Use of two or more moveable telescoping parts has the advantage that the relative speed of successive telescoping parts with respect to each other can be reduced, making it safer to walk through the bridges.

The controller can be arranged such as to overcompensate when the stroke of the oscillating motion of the telescopically extendable boom 10 is almost reached during normal compensation of the mast structure 3. For example, the controller may be arranged such as to control that the roll movement of the vessel 1 will be overcompensated in order to relieve the one or more telescoping actuators in extreme cases only, e.g. when the one or more telescoping actuators, e.g. telescoping cylinders, need a predetermined threshold percentage of their maximum stroke to compensate for the elongation or shortening of the distance between the point at which the boom 10 is coupled to the mast structure 3 and a desired point, e.g. a desired of the fixed world, where a distal end of the boom 10 is to be located. In embodiments, said predetermined threshold percentage of the maximum stroke of the one or more telescoping actuators can for instance be at least 70%, 80%, 90% or 95% of the maximum stroke. Instead of telescoping actuators a cable transmission may be used.

In the shown exemplary embodiments, the boom 10 is mounted to an elevation unit 16 being adjustable in height along the elongated mast structure 3, preferably in a continuously variable manner. For example, the elevation unit 16 can be movable attached to the mast structure 3, and can for instance be adjusted by means of a motorized rack and pinion system 20. For example, the rack 20' can be integrated in the mast structure 3 and the pinion 20" can be positioned on the elevation unit 16. Using an elevation unit 16 for adjusting the height at which the boom 10 engages the mast structure 3 can facilitate that a relatively large range of heights of offshore object landing locations can be reached, as a result of which the boom construction 2 can be a relatively versatile construction. Additionally or alternatively, height elevation by means of the elevation unit 16 can facilitate that the boom 10 can be in a relatively horizontal state during use, as a result of which people to be transferred do not have to substantially climb or to substantially go down an inclined boom, which can make the boom construction 2 relatively safe and/or said height elevation may result in a relatively high workability of the boom construction 2.

Additionally or alternatively, the boom 10 can be rotatably connected to the elongated mast structure 3 in order to allow the boom 10 to slew 14 about said elongated mast structure 3, e.g. by means of a slewing platform 21, which can be actively rotated by means of one or more slewing actuators 30, which may be controlled by the controller. Advantageously, the slewing platform 21 may be rotatably connected to the elevation unit 16 that is adjustable in height along said elongated mast structure 3.

Further, the boom construction 2 can preferably comprise at least one counterweight 22 for compensating for a moment exerted on the mast structure 3 by the boom 10 at least partly. The at least one counterweight 22 can have a center of mass located at a lateral side of the mast structure 3 substantially opposite to a side of the mast structure 3 at which said boom 10 extends from said mast structure. Said counterweight 22 can reduce a moment on the mast structure 3, but can also reduce a moment on slew bearings provided for allowing the slewing platform 21 to rotate about the mast structure 3.

The boom construction 2 can comprise an arm structure 23 for holding the counterweight or a counterweight support lever arm 23 for carrying one or more counterweights 20.

Said arm structure or lever arm 23 itself can form a part of the counterweight used for balancing the boom 10 at least partly.

Advantageously, the boom construction 2 can comprise a main part 10*a* and at least one second part 10*b*, said second part 10*b* and optional further part being telescopically movable with respect to the main part 10*a*, and if a plurality of moveable parts are used telescopically movable with respect to each other, in order to telescopically extend the length of the boom 10, wherein the boom 10 can then further comprise a movable counterweight 24 for at least partly compensating for a moment exerted on the mast structure 3 by the movable second boom part 10*b*, wherein the movable counterweight 24 has a center of mass located at a lateral side of the mast structure 3 substantially opposite to a side of the mast structure 3 at which said movable boom part 10*b* is located.

Telescoping actuators may be provided to move the counterweight 24 and the moveable telescoping part or parts. Alternatively a cable transmission coupling may be used to transmit movement of the counterweight 24 to the moveable telescoping part or parts in a reciprocal way, with a predetermined transmission ratio. The cable transmission may comprise a winch, one or more cables, wheels and/or blocks. In an embodiment a predetermined ratio between the speeds of relative movements between different pairs of telescoping parts of the beam may be used. But this not necessary. In an embodiment wherein a telescoping boom with two or more moveable telescoping parts is used, computer controlled telescoping actuators may be used, with a computer programmed to distribute the movements needed to move the distal end of the boom in a time dependent way over the moveable telescoping parts. Thus, for example, relative movement between successive telescoping parts where a person walks may be reduced.

Advantageously, the boom construction 2 can be arranged such that the boom 10 can be tilted with respect to the mast structure 3 in order to alter the angle of inclination of the boom 10. Thereto, the boom 10 can be pivotally connected to the mast structure 3, e.g. by hingedly connecting it, e.g. a first part 10*a* thereof, directly to said mast structure 3. However, in preferred embodiments, the boom 10 can be hingedly connected to the elevation unit 16, or more preferably hingedly connected to the slewing platform 21. Although a counterweight support lever arm 23 forming and/or carrying one or more counterweights 22, 24 at an opposite side of the mast structure 3 may be substantially fixedly attached to the boom 10, e.g. in order to tilt it 22, 23, 24 together with the boom 10 about a single rotation axis, the counterweight support lever arm 23 may alternatively be connected to the boom 10 by means of a four bar linkage 25, especially a parallelogram linkage 25, as is the case in the exemplary embodiments shown in the figures, which can comprise four bars of fixed length. A change in the inclination angle of the counterweight support lever arm 23 can result in a corresponding, especially equal, change in the inclination of the boom 10. For example, a first one 25*a* of the four bars of the parallelogram 25 or other four bar linkage 25 may be formed by the slewing platform 21, the elevation unit 16 or the mast structure 3. As a result, a platform, e.g. the slewing platform 21, located at or close to the mast structure 3, may for instance be kept substantially motionless, at least with respect to the mast structure 3, while an angle of inclination between the mast structure 3 and the boom 10 changes. As a result, a platform 21 can be provided which is substantially stabilized during use, as can for instance be understood from FIG. 4.

It is noted that the boom construction 2 may comprise one or multiple, preferably two, luffing cylinders 26, such as hydraulic cylinder actuators 26, or other actuators for so-called luffing, e.g. tilting the boom 10 with respect to the mast structure 3. For example, a first end 26*a* of the luffing cylinder 26 can be rotatably connected to the mast structure 3, e.g. by rotatably connecting it to the elevation unit 16 or the slewing platform 21, and an opposite second end 26*b* of the luffing cylinder 26 can be rotatably connected to another one of the four bars of the four bar linkage 25, such as for instance the counterweight support lever arm 23 or the boom 10. By connecting the second end 26*b* of a luffing cylinder 26 to the counterweight support lever arm 23 it can be counteracted that the luffing cylinder 26 is in the way, e.g. in the way of persons moving from the slewing platform 21 to the boom 10 or vice versa.

Although, in the shown exemplary embodiment, said luffing cylinder 26 engage the counterweight support lever arm 23 in order to enable tilting of said support lever arm 23, and hence tilting of the boom 10 cooperatively coupled to said support lever arm 23, e.g. by means of a parallelogram or other four bar linkage 25, it is noted that it is apparent that, in alternative embodiments, one or more luffing cylinders 26 can engage the boom 10 in stead of engaging the counterweight support lever arm 23.

Furthermore, it is noted that one or more counterweights 22, 24 and/or one or more luffing cylinders 26 can also advantageously be used in other designs, e.g. in case the counterweight support lever arm 23 and the boom 10 are substantially rigidly fixed to each other, e.g. in a manner that they 23, 10 cannot substantially pivot with respect to each other, and are arranged to integrally pivot with respect to the mast structure 3 about a single pivot axis, e.g. a pivot axis extending substantially transverse to the longitudinal direction of the mast structure. Also in such designs, one or more counterweights and/or luffing cylinders can have advantages over conventional mast structure designs having a boom, especially a gangway, suspended by cables attached to a mast structure portion located above the point at which the boom engages the mast structure. For example, they can have the advantage that said one or more counterweights and/or luffing cylinders can facilitate that the mast structure can be relatively short, e.g. because the mast structure does not need to extend above the slewing platform and/or above the boom. Consequently, the mast structure can be kept relatively low and/or light with respect to the maximum working height of the boom. As a result of the relatively low weight of the boom construction 2, the construction may be relatively easy to install and/or may be suitable for relatively small vessel in comparison to both known hexapod type gangway constructions and known crane-like type gangway constructions with mast structures. Moreover, the boom construction 2 may be free of hoisting winches, as result of which such it can be free of hoisting winch fatigue.

Figure 6:
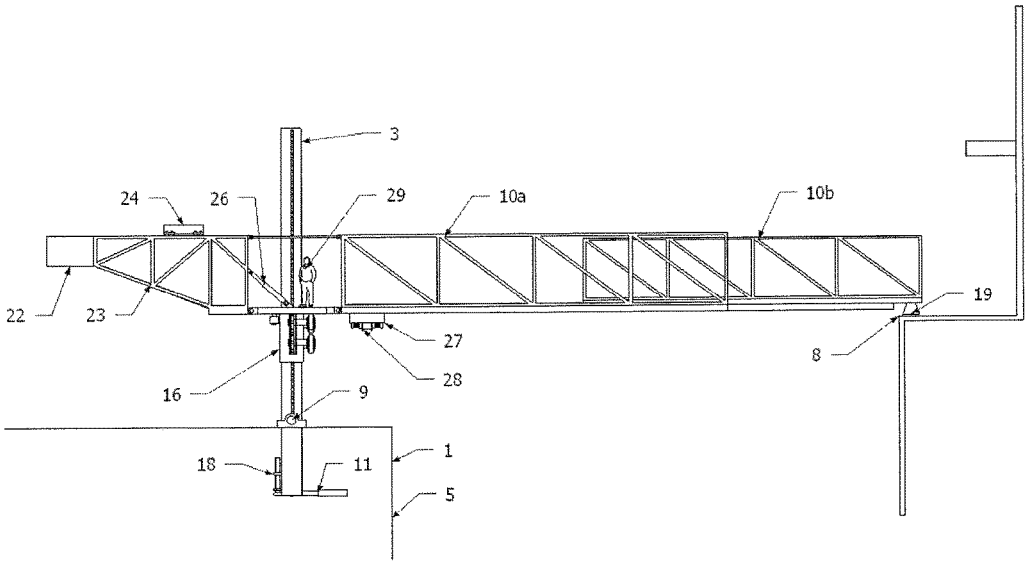
FIG. 6 shows a schematic, partly cut-away view of an alternative boom construction in a mode for transferring persons.
Figure 7:
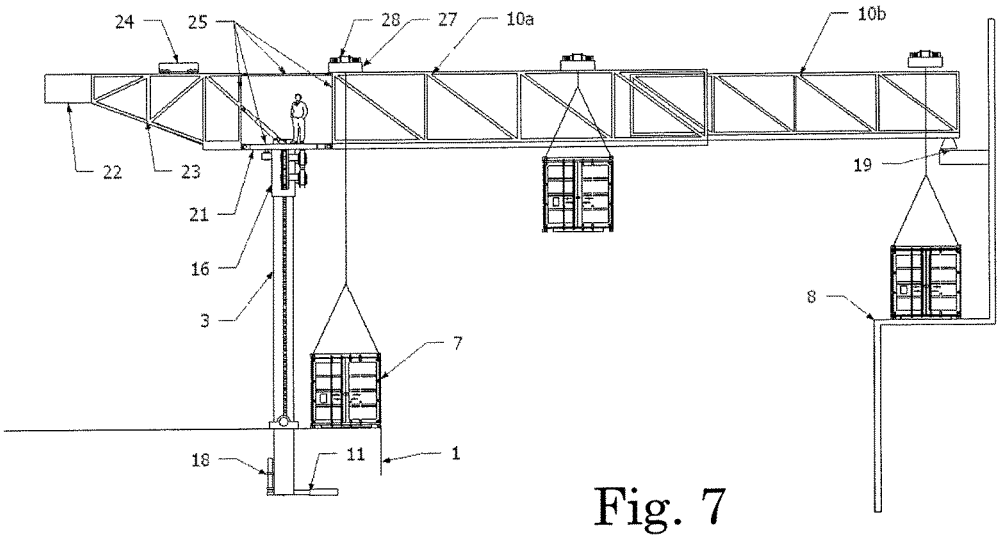
FIG. 7 shows a schematic, partly cut-away view of yet a further alternative boom construction in a mode for transferring cargo.

Additionally or alternatively, such as for instance can be seen in the exemplary embodiments of FIGS. 6 and 7, the boom construction 2 can, in preferred embodiments, further comprise a coupler 19 located at or near a distal end of the boom 10 for coupling the boom 10 to an offshore object 8, preferably in a rotatably manner. The offshore object 8 may for example be another vessel, e.g. in seaway, or an offshore structure or so-called offshore construction, such as for instance an offshore platform or a wind turbine. The coupler 19 can for instance comprise a landing foot, such as an electro-magnetic foot. However, many different couplers, e.g. comprising a docking head, are possible.

As can be seen in the exemplary embodiment shown in FIG. 7, the boom construction 2 may be formed as a gangway construction 2 that may be provided with a trolley 27, which can be movable along at least a portion of the boom 10. Said trolley 27 can preferably be arranged for holding a load, e.g. in order to carry cargo 7 to be moved between an offshore object 8 and the vessel 1 provided with the boom construction 2. The trolley 27 may be a crane trolley and can be provided with a hoist 28 for hoisting cargo 7. The trolley may facilitate that the vessel 1 does not need both a gangway construction for transferring people and a separate system, e.g. a conventional crane system, for transferring cargo.

During use, embodiments of the present boom construction 2 can be used to provide a temporarily connection between a vessel 1 and an offshore object 8. For example, the vessel 1 can be located close to said offshore object 8, and can be kept substantially in position. The boom 10 can be brought in a substantially horizontal position, can be elevated along the mast structure 3, and/or can be slewed, e.g. towards the offshore object 8. A distal tip or end portion of the boom 10 can be moved towards a location where it is to be coupled to the offshore object 8. The mast structure 3 can be compensated at least partly for the vessel's roll motion, if desired even overcompensated, by means of the at least one mast pivoting actuator 11, the slewing platform 21 can actively be rotated about the mast structure's longitudinal axis 15 in order to compensate for the vessel's pitch motion at least partly by means of the one or more slewing actuators 30, the telescoping boom 10 can be retracted and extended actively, e.g. by means of one or more telescoping actuators, for example in order to compensate at least partly for changes in the distance between the coupling location at the offshore structure 8 and a proximal end of the boom 10 attached to the mast structure 3, and the at least one luffing cylinder 26 can actively adjust the angle between the mast structure 3 and the boom 10, e.g. to keep the boom 10 at a predetermined angle with respect to the horizon. Hence the distal end portion of the boom 10 can be kept substantially motionless with respect to the fixed world and/or can be moved to desired spot, e.g. said coupling location, in a controlled manner. Once the distal end portion of the boom 10 is coupled to the offshore object 8, the one or more slewing actuators 30, the one or more telescoping actuators, and the one or more luffing actuators 26 can be brought into a neutral position, e.g. out of gear. Hence, the extendable boom 10 can be brought into a passive mode of operation or a so-called float mode, in which the position of the mast structure 3 can be compensated for the vessel's roll motion and in which other motions are passively compensated for.

It is noted that the boom construction 2 can advantageously thus be arranged to bring the one or more slewing actuators 30, preferably formed by one or more radial piston motors 30, the one or more telescoping actuators, preferably formed by one or more radial piston motors, and the one or more luffing actuators 26, preferably formed by one or more hydraulic cylinders of which the chambers can be temporarily fluidly interconnected in order to bring them in a passive mode, into a neutral position, preferably substantially simultaneously. For example, the boom construction 2 and/or its controller may be arranged to bring said slewing, telescoping and luffing actuators into their neutral position when the coupler 19 couples to the offshore object 8. Thereto, the boom construction 2 may for instance comprise one or more sensors for sensing whether the coupler is coupled and/or whether the coupler 19 or a landing foot thereof, e.g. an electro-magnetic foot, is activated.

Advantageously, the slewing platform 21 can be elevated or lowered while the boom construction 2 is in its passive or neutral mode, e.g. in order to install a crane trolley 27 to the boom 10.

Moreover, it is noted that advantageous features of the vessel and/or the boom construction, especially forming a gangway construction, disclosed herein can be advantageously employed in other vessels and/or boom constructions. For example, one or more of such features can also be advantageously utilized in a vessel provided with a boom construction, especially a gangway construction, for transferring persons and/or cargo from said vessel to an offshore object or vice versa, wherein the boom construction comprises an elongated mast structure extending in a direction substantially upwards from a deck of said vessel, wherein said mast structure is pivotally mounted with respect to a hull of the vessel in a manner such as to be pivotable with respect to said hull about two pivot axes, preferably two substantially transverse pivot axes, more preferably provided in a two-axes gimbal structure, wherein the boom construction further comprises a boom, especially a gangway, connected to the mast structure and extending from the mast structure in a substantially sideward direction, and wherein the boom construction comprises at least two actuators for pivoting the mast structure such as to compensate for at least a part of a rolling movement of the hull of the vessel and at least a part of the pitching movement of the vessel's hull. It will be apparent that one or more of such features can also be utilized in such boom construction as such. For instance, the feature of overcompensation of the rolling motion of the vessel, the feature of at least partly balancing the boom by means of one or more counterweights, the feature of providing the elevating unit, the feature of locking the mast structure by a mechanical locking mechanism and/or the feature of adapting the angle of inclination of the boom by means of one or multiple luffing cylinders can be advantageously utilized in a boom construction having a motion compensated mast structure mounted to a vessel by means of a two-axes gimbal structure.

Besides, it is noted that for the purpose of clarity and a concise description features are described herein as part of the same or separate embodiments, however, it will be appreciated that the scope of the invention may include embodiments having combinations of all or some of the features described.

For example, it is evident to the skilled reader that features disclosed in the context of a vessel provided with a boom construction are also deemed to be with disclosed in the context of a boom construction as such.

Further, it is noted that the invention is not restricted to the embodiments described herein. It will be understood that many variants are possible.

For example, the boom construction can comprise an elevator or a stairway, e.g. for allowing one or more persons to move from a deck of the vessel to the slewing platform and/or the boom of the boom construction, or vice versa.

Such and other variants will be apparent for the person skilled in the art and are considered to lie within in the scope of the invention as formulated in the following claims.

The invention claimed is:

1. A vessel provided with a boom construction for transferring persons and/or cargo from said vessel to an offshore object or vice versa, the boom construction comprising:

an elongated mast structure extending in a direction substantially upwards from a deck of said vessel, wherein said mast structure is pivotally mounted with respect to a hull of the vessel in a manner such as to be pivotable with respect to said hull about a single pivot axis only;

a boom connected to the mast structure and extending from the mast structure in a lateral direction; and at least one actuator for pivoting the mast structure in order to compensate for at least a part of a roll movement of the hull of the vessel; and at least one counterweight, disposed at an end of said boom, for compensating for a moment exerted on the mast structure by the boom at least partly, said at least at least one counterweight having a center of mass located at a side of the mast structure substantially opposite to a side of the mast structure at which said boom extends from said mast structure.

2. The vessel according to claim 1, wherein the vessel is an elongated vessel extending in a longitudinal direction and said single pivot axis extends substantially in the longitudinal direction of the vessel.

3. The vessel according to claim 1, wherein the boom is rotatably connected to the elongated mast structure in order to allow the boom to slew about said elongated mast structure.

4. The vessel according to claim 1, wherein the counterweight comprises a movable counterweight.

5. The vessel according to claim 1, wherein the mast structure extends from above the single pivot axis beyond said single pivot axis to a point located below said single pivot axis, wherein said at least one actuator for pivoting the mast structure engages the mast structure at a position located below said single pivot axis.

6. The vessel according to claim 5, wherein said at least one actuator comprises a piston actuator.

7. The vessel according to claim 4, wherein the counterweight is connected to the boom via a four bar linkage.

8. The vessel according to claim 1, wherein the vessel is an elongated vessel extending in a longitudinal direction, and wherein the vessel is arranged to control the at least one actuator in order to allow said at least one actuator to compensate for at least a part of the roll movement of the hull.

9. The vessel according to claim 8, wherein the vessel, arranged to control the at least one actuator in order to allow said at least one actuator to compensate for at least a part of the roll movement of the hull, is arranged such that a center line of the mast structure, during rolling of the vessel, is configured to be kept substantially parallel with a virtual vertical plane extending in the longitudinal direction of the vessel.

10. The vessel according to claim 1, wherein the vessel is arranged to overcompensate the mast structure by tilting the mast structure with respect to the hull further than is needed to compensate for the roll movement of the hull of the vessel, and/or the vessel is arranged to undercompensate the mast structure by tilting the mast structure with respect to the hull less than is needed to completely compensate for the roll movement of the hull of the vessel.

11. The vessel according to claim 10, wherein the vessel, arranged to overcompensate the mast structure and/or arranged to undercompensate the mast structure, is arranged in such manner that, during rolling of the vessel, the center line of the mast structure is configured to be tilted with respect to a virtual vertical plane extending in the longitudinal direction of the vessel in a direction opposite to the direction in which the vessel rolls.

12. The vessel according to claim 1, further comprising at least one luffing cylinder for tilting the boom with respect to the mast structure, wherein a first end of the luffing cylinder is rotatably connected to the mast structure, and an opposite second end of the luffing cylinder is rotatably connected (a) to a counterweight support lever arm for holding a counterweight or (b) to the boom, in order to tilt the boom when the cylinder is retracted or extended, wherein the at least one luffing cylinder has a neutral position that provides a passive mode of operation by which the position of the boom relative to the mast structure is passively compensated for.

13. The vessel according to claim 12, wherein the boom is rotatably connected to the elongated mast structure in order to allow the boom to slew about said elongated mast structure by means of a slewing platform rotatably connected to an elevation unit that is adjustable in height along said elongated mast structure, and wherein the first end of the luffing cylinder rotatably connected to the mast structure is rotatably connected to said mast structure via the slewing platform.

14. A vessel provided with a boom construction for transferring persons and/or cargo from said vessel to an offshore object or vice versa, the boom construction comprising:

an elongated mast structure extending in a direction substantially upwards from a deck of said vessel, wherein said mast structure is pivotally mounted with respect to a hull of the vessel in a manner such as to be pivotable with respect to said hull about a pivot axis;

a boom connected to the mast structure and extending from the mast structure in a substantially sideward direction; and at least one actuator for pivoting the mast structure in order to compensate for at least a part of a roll movement of the hull of the vessel; and at least one movable counterweight for compensating for a moment exerted on the mast structure by the boom at least partly, said at least one counterweight having a center of mass located at a side of the mast structure substantially opposite to a side of the mast structure at which said boom extends from said mast structure, wherein the movable counterweight is connected to the boom via a four bar linkage, wherein the boom is mounted to an elevation unit being adjustable in height along at least a portion of the elongated mast structure in a continuously variable manner.

15. The vessel according to claim 14, wherein the elevation unit, being adjustable in height along the elongated mast structure, is adjustable in height by means of a motorized rack and pinion system.

16. The vessel according to claim 14, wherein said mast structure is pivotally mounted with respect to the hull in a manner such as to be pivotable with respect to said hull about a single pivot axis only.

17. A boom construction for transferring persons and/or cargo from a vessel to an offshore object or vice versa, the boom construction comprising:

an elongated mast structure arranged to be pivotably mounted with respect to a hull of a vessel, the mast structure configured to be pivotable about a single pivot axis only, in a manner in which the mast structure extends in a direction substantially upwards from a deck of said vessel, and a boom arranged for connection to the mast structure and arranged to extend from the mast structure in a lateral direction during use of the boom construction; and at least one movable counterweight for compensating for a moment exerted on the mast structure by the boom at least partly, said at least one counterweight having a center of mass located at a side of the mast structure substantially opposite to a side of the mast structure at which said boom extends from said mast structure, wherein the movable counterweight is connected to the boom via a four bar linkage wherein the boom construction is arranged to be coupled to at least one actuator for pivoting the mast structure during use in order to compensate for at least a part of a roll movement of the hull of the vessel.

18. The boom construction of claim 17, wherein the mast structure comprises a hinge part for pivotally mounting the mast structure to the hull of the vessel, and wherein the mast structure is arranged for connection of the boom to the mast structure at a position located at a first side of the hinge part and wherein the mast structure is further arranged for coupling the at least one actuator to the mast structure at a position located at an opposite side of the mast structure.

19. The boom construction according to claim 17, wherein said boom construction is a gangway construction and said boom forms a gangway.

20. The boom construction according to claim 17, wherein the least one actuator is a piston actuator.

21. A vessel provided with a boom construction for transferring persons and/or cargo from said vessel to an offshore object or vice versa, the boom construction comprising:

an elongated mast structure extending in a direction substantially upwards from a deck of said vessel, wherein said mast structure is pivotally mounted with respect to a hull of the vessel in a manner such as to be pivotable with respect to said hull about a pivot axis;

a boom connected to the mast structure and extending from the mast structure in a substantially sideward direction; and at least one actuator for pivoting the mast structure in order to compensate for at least a part of a roll movement of the hull of the vessel, wherein the boom is rotatably connected to the elongated mast structure in order to allow the boom to slew about said elongated mast structure, wherein the boom, rotatably connected to the elongated mast structure, is connected to said elongated mast structure by means of a slewing platform rotatably connected to an elevation unit that is adjustable in height along said elongated mast structure.

22. The vessel according to claim 21, wherein said mast structure is pivotally mounted with respect to the hull in a manner such as to be pivotable with respect to said hull about a single pivot axis only.

23. A boom construction for transferring persons and/or cargo from a vessel to an offshore object or vice versa, the boom construction comprising:

an elongated mast structure arranged to be pivotably mounted with respect to a hull of a vessel, the mast structure configured to be pivotable about a pivot axis, in a manner in which the mast structure extends in a direction substantially upwards from a deck of said vessel, and a boom arranged for connection to the mast structure and arranged to extend from the mast structure in a substantially sideward direction during use of the boom construction, wherein the boom construction is arranged to be coupled to at least one actuator for pivoting the mast structure during use in order to compensate for at least a part of a roll movement of the hull of the vessel, wherein the boom is rotatably connected to the elongated mast structure in order to allow the boom to slew about said elongated mast structure, wherein the boom, rotatably connected to the elongated mast structure, is connected to said elongated mast structure by means of a slewing platform rotatably connected to an elevation unit that is adjustable in height along said elongated mast structure.

24. The boom construction of claim 23, wherein the mast structure is configured to be pivotable about a single pivot axis only.

25. A boom construction for transferring persons and/or cargo from a vessel to an offshore object or vice versa, the boom construction comprising:

an elongated mast structure arranged to be pivotably mounted with respect to a hull of a vessel, the mast structure configured to be pivotable about a pivot axis, in a manner in which the mast structure extends in a direction substantially upwards from a deck of said vessel, and a boom arranged for connection to the mast structure and arranged to extend from the mast structure in a substantially sideward direction during use of the boom construction, wherein the boom construction is arranged to be coupled to at least one actuator for pivoting the mast structure during use in order to compensate for at least a part of a roll movement of the hull of the vessel, wherein the boom is mounted to an elevation unit being adjustable in height along at least a portion of the elongated mast structure in a continuously variable manner.

26. The boom construction of claim 25, wherein the elevation unit, being adjustable in height along the elongated mast structure, is adjustable in height by means of a motorized rack and pinion system.

27. The boom construction of claim 25, wherein the mast structure is configured to be pivotable about a single pivot axis only.

* * * * *